US012037165B1

(12) United States Patent
Carver et al.

(10) Patent No.: US 12,037,165 B1
(45) Date of Patent: Jul. 16, 2024

(54) CONTAINER ADAPTER LIDS

(71) Applicant: Kaug Designs, Inc., Portand, OR (US)

(72) Inventors: John Carver, Portland, OR (US); David T. Helbley, Sherwood, OR (US); Kelley Carver, Portland, OR (US)

( * ) Notice: Subject to any disclaimer, the term of this patent is extended or adjusted under 35 U.S.C. 154(b) by 38 days.

(21) Appl. No.: 17/494,195

(22) Filed: Oct. 5, 2021

Related U.S. Application Data

(63) Continuation-in-part of application No. 16/404,013, filed on May 6, 2019, now abandoned, which is a continuation-in-part of application No. 15/844,943, filed on Dec. 18, 2017, now Pat. No. 10,322,857, application No. 17/494,195 is a continuation-in-part of application No. 29/672,602, filed on Dec. 6, 2018.

(51) Int. Cl.

| | |
|---|---|
| ***B65D 45/32*** | (2006.01) |
| ***B65D 47/12*** | (2006.01) |
| ***B65D 47/20*** | (2006.01) |
| ***B65D 51/02*** | (2006.01) |
| ***B65D 51/28*** | (2006.01) |
| ***B65D 53/02*** | (2006.01) |
| ***B65D 81/20*** | (2006.01) |

(52) U.S. Cl.
CPC ..... *B65D 47/123* (2013.01); *B65D 45/325* (2013.01); *B65D 47/121* (2013.01); *B65D 47/2018* (2013.01); *B65D 51/02* (2013.01); *B65D 51/2821* (2013.01); *B65D 53/02* (2013.01); *B65D 81/2015* (2013.01); *B65D 81/2038* (2013.01); *B65D 2539/003* (2013.01); *B65D 2547/063* (2013.01)

(58) Field of Classification Search
CPC ..... B65D 2547/066; B65D 2539/003; B65D 45/325; B65D 47/2018; B65D 2543/00129; B65D 2543/00111
USPC ..... 215/270
See application file for complete search history.

(56) References Cited

U.S. PATENT DOCUMENTS

| | | | | |
|---|---|---|---|---|
| 4,603,784 | A * | 8/1986 | Chang | A61J 9/008 215/11.1 |
| 4,823,969 | A * | 4/1989 | Caldwell | C12C 13/10 220/203.11 |
| 5,215,717 | A | 6/1993 | Conant et al. | |
| 5,240,131 | A | 8/1993 | Keller | |
| 5,944,212 | A | 8/1999 | Chang | |
| 6,945,389 | B2 * | 9/2005 | Scherer | A61L 12/086 206/5.1 |

(Continued)

*Primary Examiner* — Anthony D Stashick
*Assistant Examiner* — Raven Collins
(74) *Attorney, Agent, or Firm* — Miller IP Law; Devin Miller

(57) ABSTRACT

A method, system, apparatus, and/or device for an adapter lid of a container. The method, system, apparatus, and/or device may include a planar wall extending along a horizontal plane, the planar wall being configured to attach to a gasket and extend along a rim of a container, where the planar wall includes an opening to provide a passage for the object to enter a cavity of the container. The method, system, apparatus, and/or device may include an opening wall configured to circumscribe the opening and extend from the horizontal plane to form a spout, where the adapter lid is configured to attach to the rim of the container in a normal orientation and attach to the rim of the container in a reverse orientation.

13 Claims, 12 Drawing Sheets

(56) References Cited

U.S. PATENT DOCUMENTS

| | | | | |
|---|---|---|---|---|
| 2002/0079319 | A1* | 6/2002 | Krieger | B29C 51/00 220/660 |
| 2017/0066568 | A1* | 3/2017 | Stever | B65D 77/068 |
| 2018/0360245 | A1* | 12/2018 | Belmar | B65D 47/142 |

* cited by examiner

CONTAINER ADAPTER LIDS

CROSS-REFERENCE TO RELATED APPLICATIONS

The present application is a continuation-in-part of U.S. Non-Provisional patent application Ser. No. 16/404,013 entitled "CONTAINER ADAPTER LIDS", filed on 6 May 2019, which is a continuation-in-part of U.S. Non-Provisional patent application Ser. No. 15/844,943 entitled "CONTAINER ADAPTER LIDS", filed on 18 Dec. 2017, now U.S. Pat. No. 10,322,857, and claims the benefit of U.S. Design patent application No. 29/672,602, filed 6 Dec. 2018. The entire contents of the above-listed applications are hereby incorporated by reference for all purposes.

BACKGROUND

Jars may be used to store a number of assorted items. For example, decorative jars such as Mason jars, apothecary jars, and jelly jars may be used to store objects. The objects may include food, liquids, lights, miscellaneous objects, and so forth. An individual may choose different jars to store objects based on the size and shape of the jar, the material of the jar, the aesthetic nature of the jar, the functionality of the jar, and so forth.

SUMMARY

A container adapter lid including a gasket, an adapter lid, and a container band. The gasket may be shaped to attach to a rim of a container to form a seal between the rim and the gasket. The adapter lid may include an opening shaped to receive an adapter or accessory. The container band may be shaped to attach the gasket and the adapter lid to the rim of the container.

BRIEF DESCRIPTION OF THE DRAWINGS

The present description will be understood more fully from the detailed description given below and from the accompanying drawings of various embodiments of the present embodiment, which, however, should not be taken to limit the present embodiment to the specific embodiments, but are for explanation and understanding only.

embodiment.

Figure 4A:
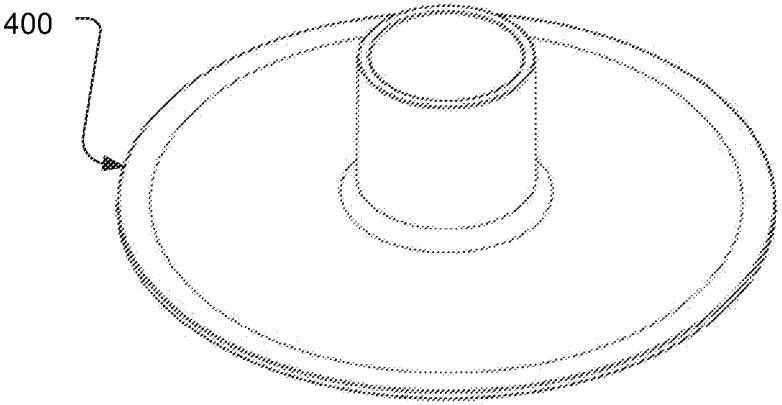
FIG. 4A illustrates an adapter lid without a gasket, according to an embodiment.
Figure 4B:
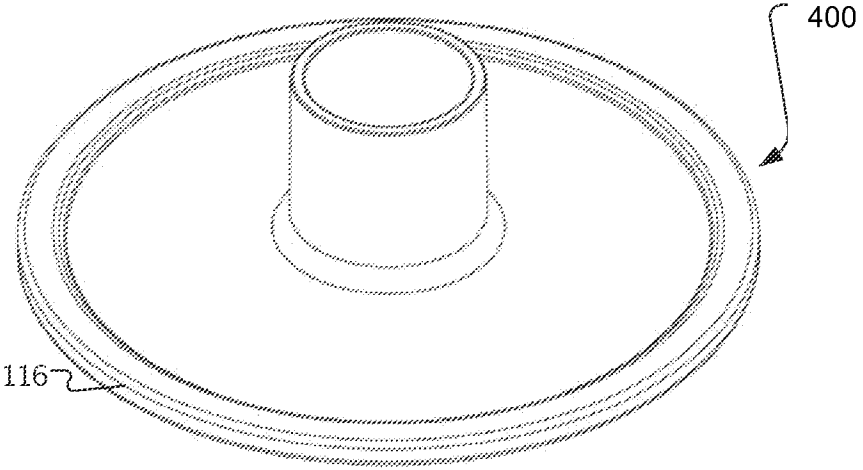
FIG. 4B illustrates an adapter lid with a gasket, according to an embodiment.
Figure 4C:
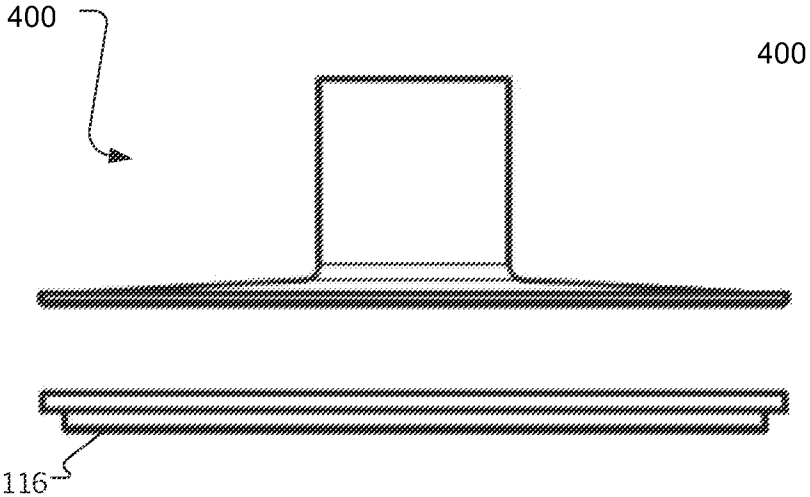

FIG. 4C illustrates an adapter lid in a normal orientation with a gasket, according to an embodiment.

Figure 4D:
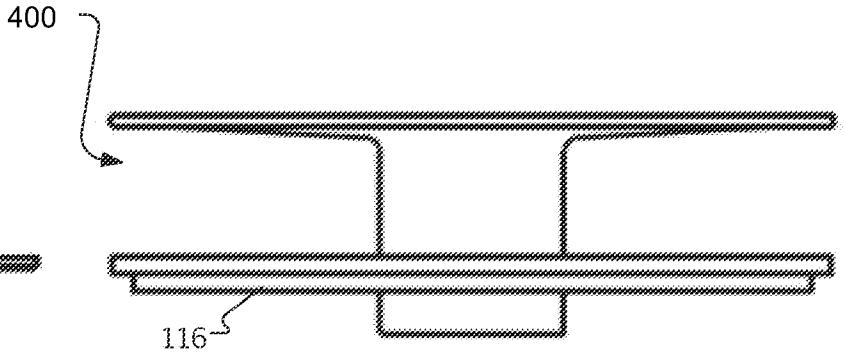

FIG. 4D illustrates an adapter lid in a reverse orientation with a gasket, according to an embodiment.

Figure 5A:
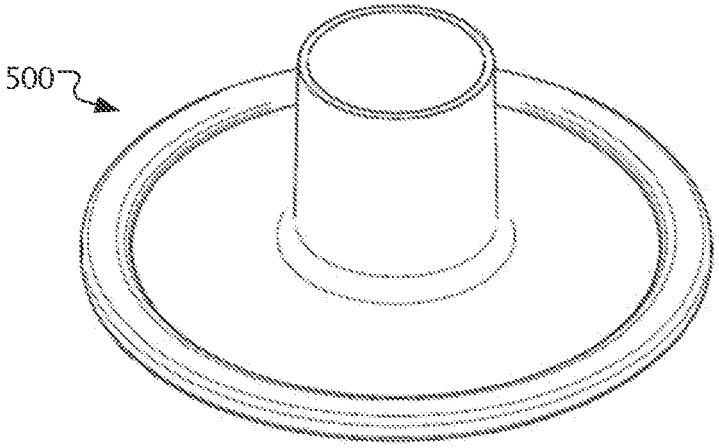

FIG. 5A illustrates an adapter lid having a first diameter for a container with an opening having a second diameter, according to an embodiment.

Figure 5B:
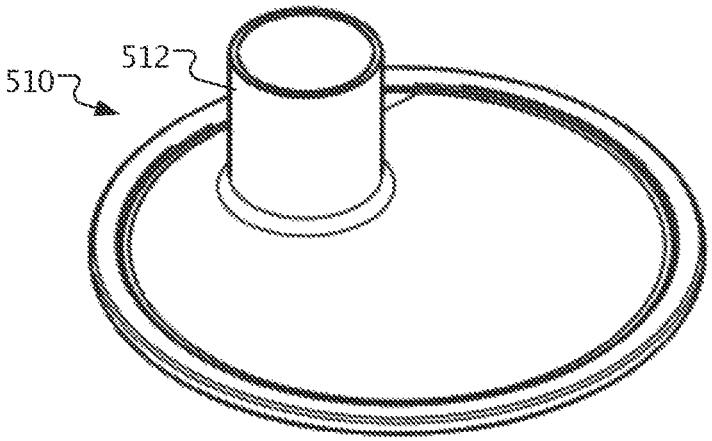

FIG. 5B illustrates an adapter lid having an offset or off-center opening wall, according to an embodiment.

Figure 5C:
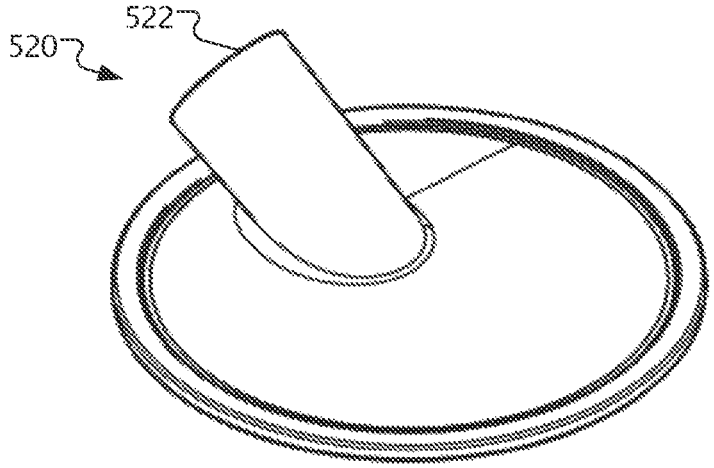

FIG. 5C illustrates an adapter lid having an angled opening wall, according to an embodiment.

Figure 6A:
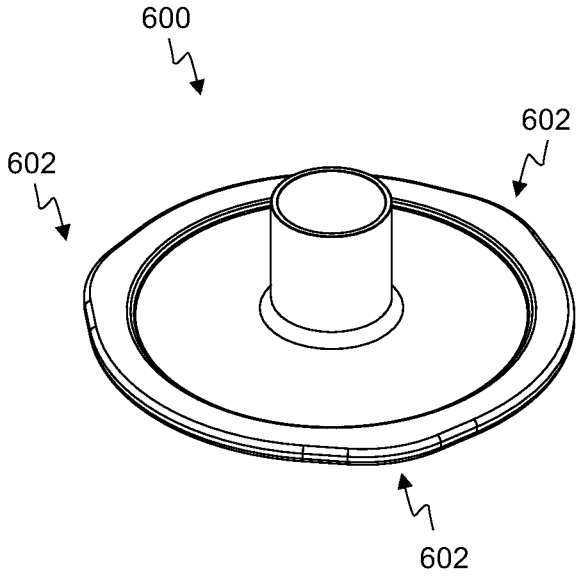

FIG. 6A illustrates a perspective view of a container system, according to an embodiment.

Figure 6B:
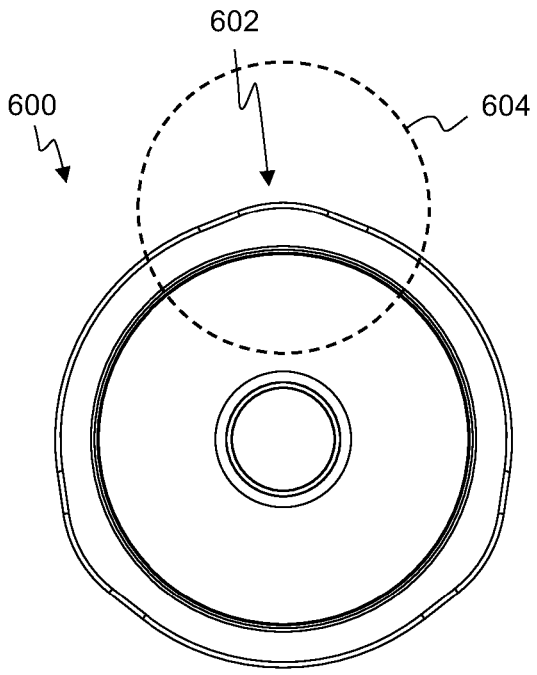

FIG. 6B illustrates an exploded view a container system, according to an embodiment.

Figure 6C:
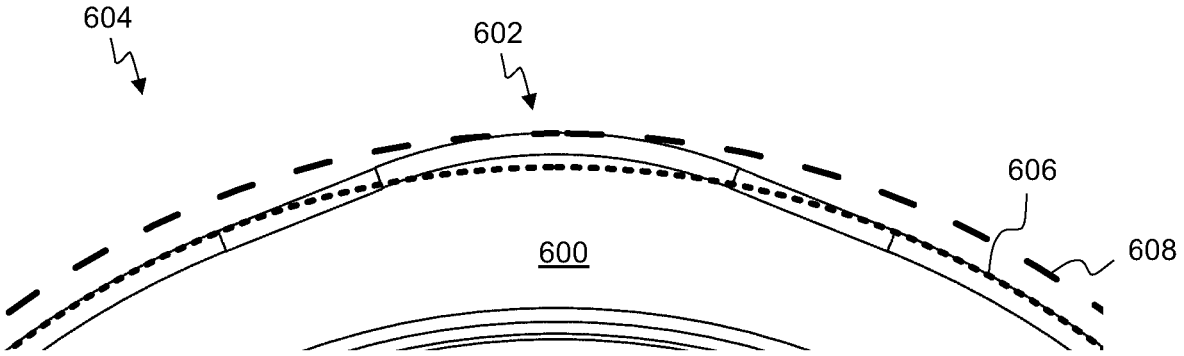

FIG. 6C illustrates the detail view of the adapter lid, according to an embodiment.

Figure 7A:
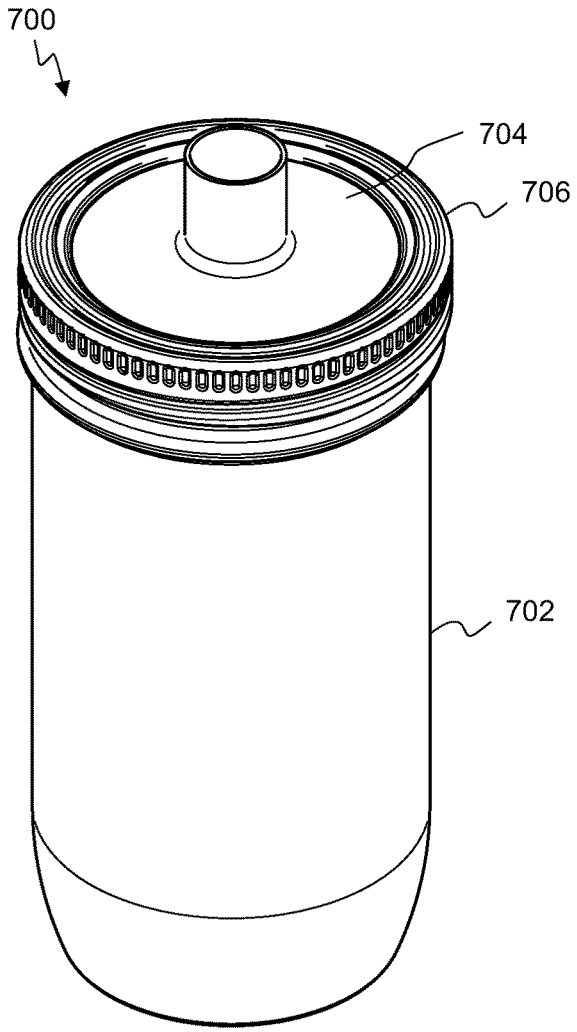

FIG. 7A illustrates an exploded view of a lid assembly, according to an embodiment.

Figure 7B:
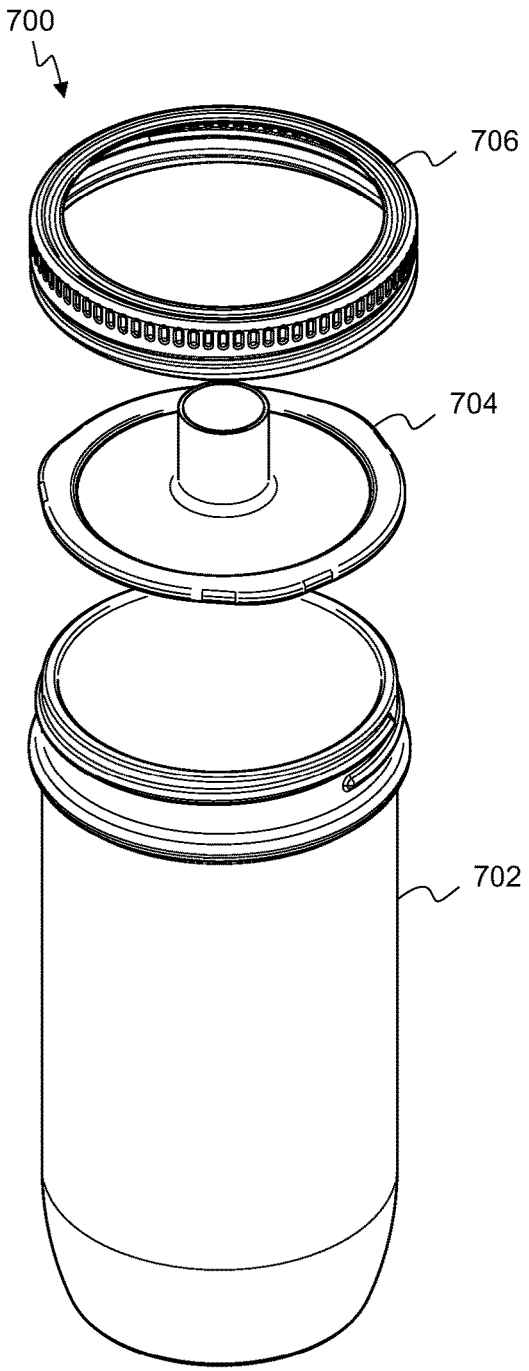

FIG. 7B illustrates an exploded view of a lid assembly, according to an embodiment.

Figure 8A:
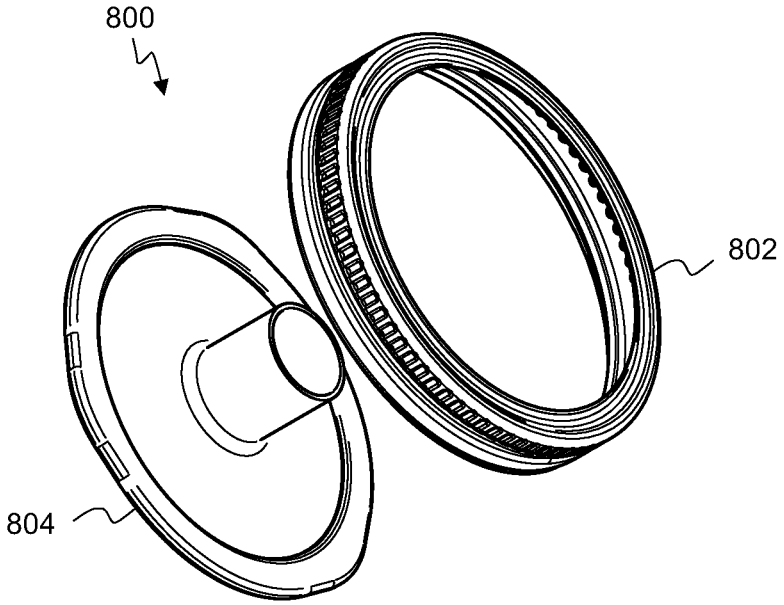

FIG. 8A illustrates a perspective view of an adapter lid, according to an embodiment.

Figure 8B:
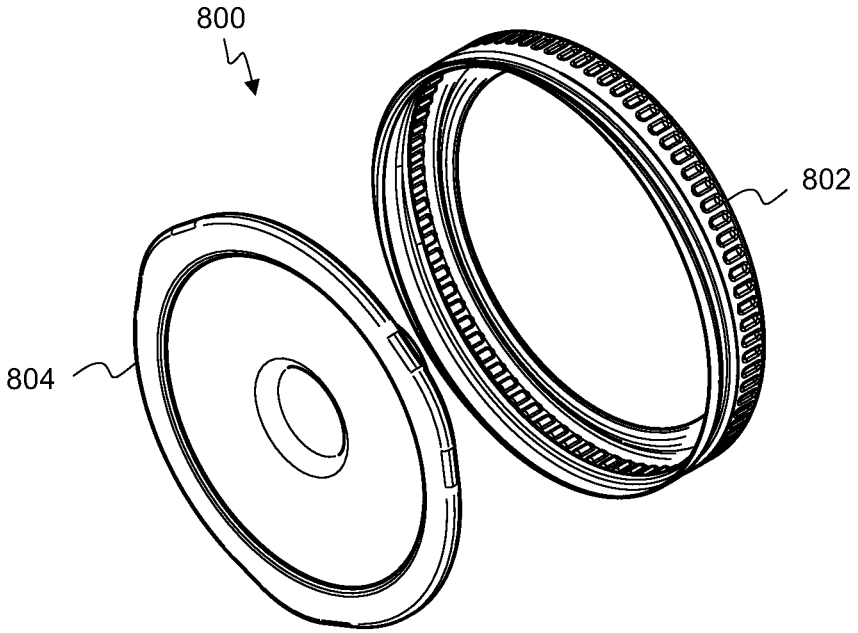

FIG. 8B illustrates a top view of an adapter lid, according to an embodiment.

Figure 9A:
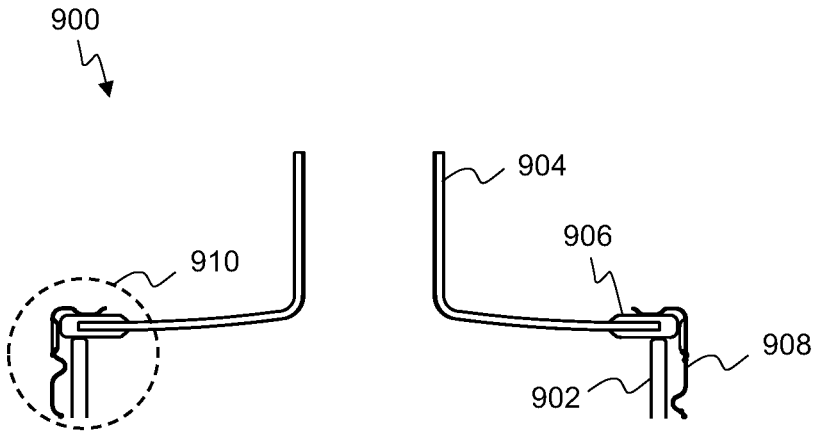

FIG. 9A illustrates a cross section view of a container system, according to an embodiment.

Figure 9B:
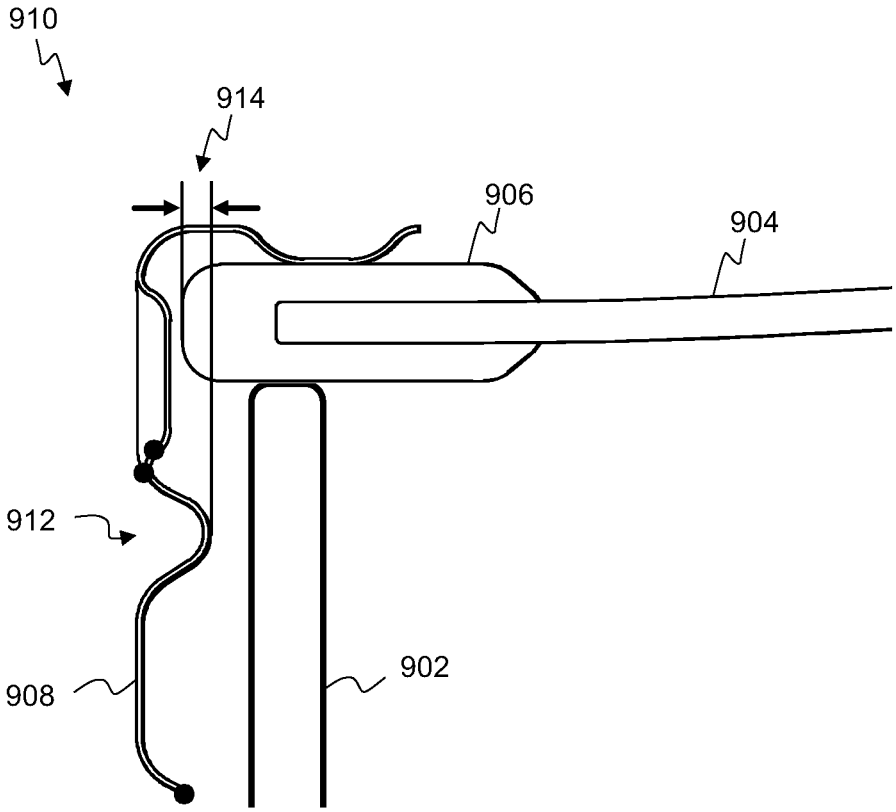

FIG. 9B illustrates a detail view of a container system, according to an embodiment.

Figure 10A:
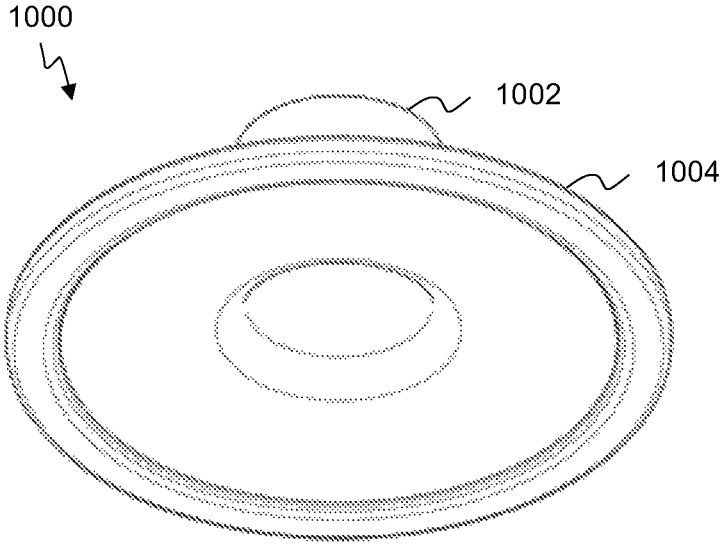

FIG. 10A illustrates a bottom perspective view of an adapter lid assembly, according to an embodiment.

Figure 10B:
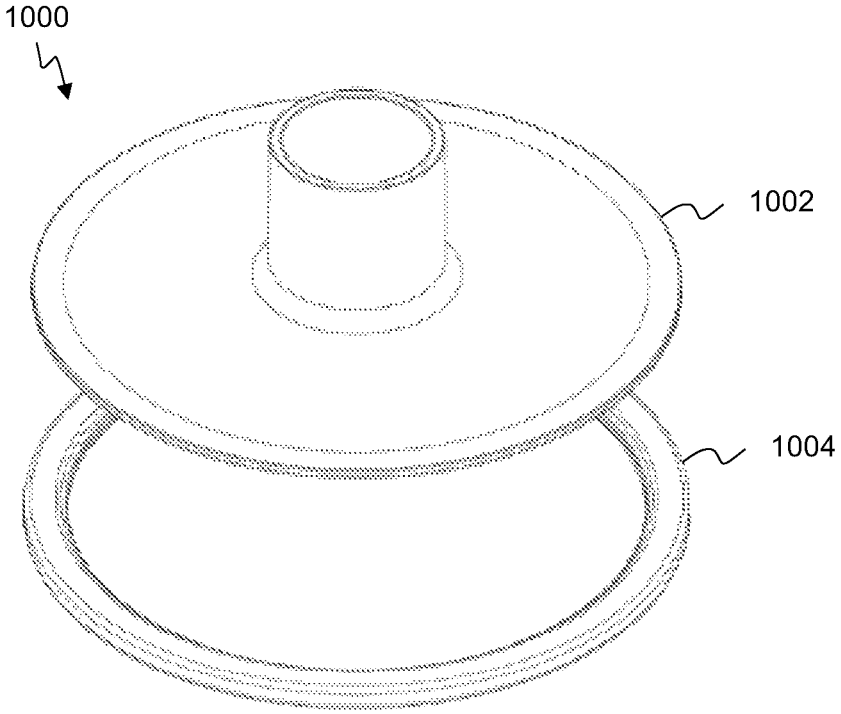

FIG. 10B illustrates an exploded view of an adapter lid assembly, according to an embodiment.

Figure 11A:
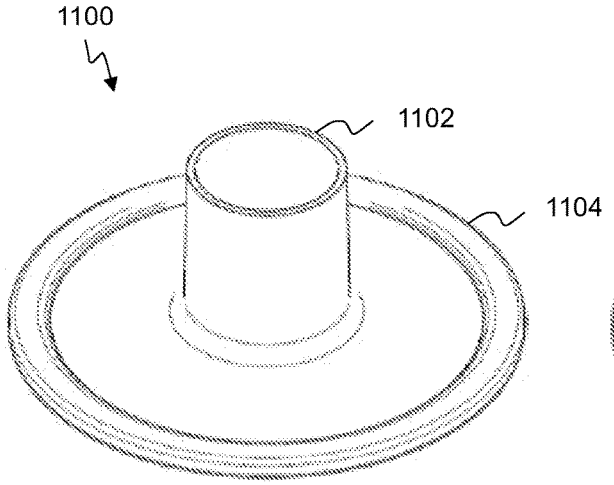

FIG. 11A illustrates a top perspective view of an adapter lid assembly, according to an embodiment.

Figure 11B:
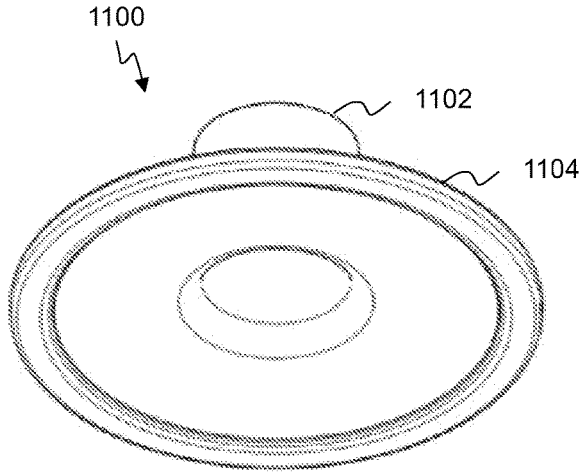

FIG. 11B illustrates a bottom perspective view of an adapter lid assembly, according to an embodiment.

Figure 11C:
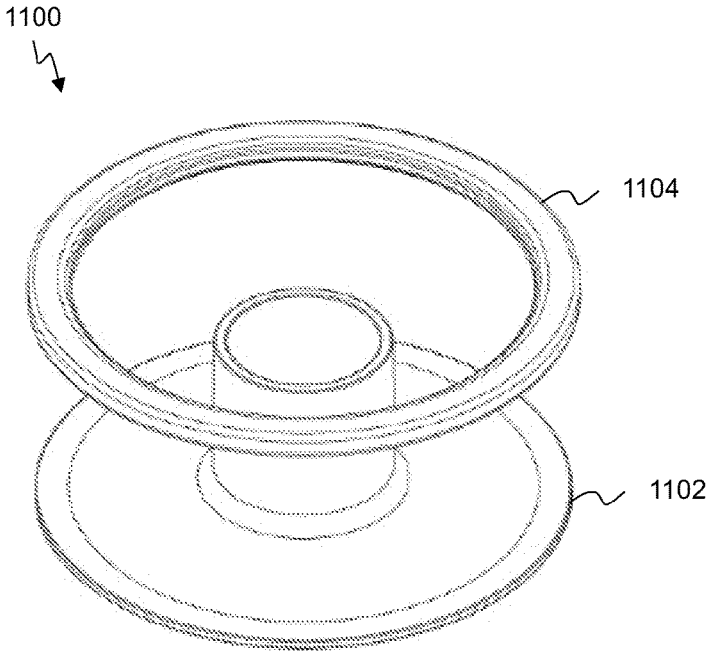

FIG. 11C illustrates an exploded view of an adapter lid assembly, according to an embodiment.

DETAILED DESCRIPTION

The disclosed container adapter lids will become better understood through a review of the following detailed description in conjunction with the figures. The detailed description and figures provide merely examples of the various embodiments described herein. Those skilled in the art will understand that the disclosed examples may be varied, modified, and altered without departing from the scope of the embodiments described herein. Many variations are contemplated for different applications and design considerations; however, for the sake of brevity, each and every contemplated variation is not individually described in the following detailed description.

Throughout the following detailed description, examples of various container adapter lids are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Individuals may use containers to store, display, and organize a variety of objects. The containers may vary in size, shape, material, functionality, and so forth. For example, the jars may be used to store a number of assorted items. Decorative jars, such as Mason jars, apothecary jars, and jelly jars may be used to store, display, and organize objects. The objects may include food, liquids, cannabis, medication, lights, miscellaneous objects, and so forth.

Individuals may use different containers to store objects based on the aesthetic nature of the container. For example, the decorative elements of Mason jars make them popular ornamental motifs. Objects may be stored in Mason jars to highlight an aesthetic nature of the objects and the Mason jar. Lights may be positioned in, or adjacent to, the jars to illuminate the contents of the jars in an aesthetically-pleasing manner.

The Mason jars may also have functional advantages for storing objects. For example, conventional Mason jars are transparent or translucent. When objects are stored in the Mason jars, an individual may be able to see the objects within the Mason jar to determine an amount of the object left in the Mason jar or a status of the object in the Mason jar without opening the Mason jar. For example, when Mason jars are used to store food or a liquid, an individual may visually inspect the food or the liquid within the Mason jars to determine an amount of food within the Mason jar and whether the food or liquid appears to be fresh and edible. Mason jars may also provide a food-safe container to foods and liquids, as the glass material may be non-porous and the material of the Mason jars may not leach onto the food or liquid. The Mason jars may also repel odors so that the Mason jars may be reused to store different foods or liquids without contaminating the foods or the liquids with the previous objects stored in the Mason jars.

While containers, such as Mason jars, may provide several benefits for storing, displaying, and organizing objects, conventional Mason jar lids may limit the type of objects that are stored in the Mason jars. For example, storing food or a liquid in a Mason jar long term may be difficult as sealing a lid to a Mason jar may be a prolonged and arduous process of heating and cooling the Mason jar with the lid. Additionally, conventional lids must be removed to access objects stored in the Mason jars. When the lid is removed, the objects stored in the Mason jar may be exposed to a large amount of air, which may spoil or ruin the objects over a period of time. The conventional Mason jar lids may also be a hindrance when removing the objects, such as food or liquid, from the Mason jars and the relatively large mouth of the Mason jars may make it difficult for an individual to remove the food or the liquid from the Mason jars. For example, the relatively large mouth of the Mason jar may make it difficult to pour the food or the liquid from the Mason jars.

The embodiments described herein may address the above-noted deficiencies by providing a container jar lid. The container jar lid may include a gasket and an adapter lid. The gasket may form a seal between a container and the adapter lid. The adapter lid may include an opening to receive one or more lid accessories. The container adapter lid may include the container band that may fasten the gasket and the adapter lid to the container.

Figure 1A:
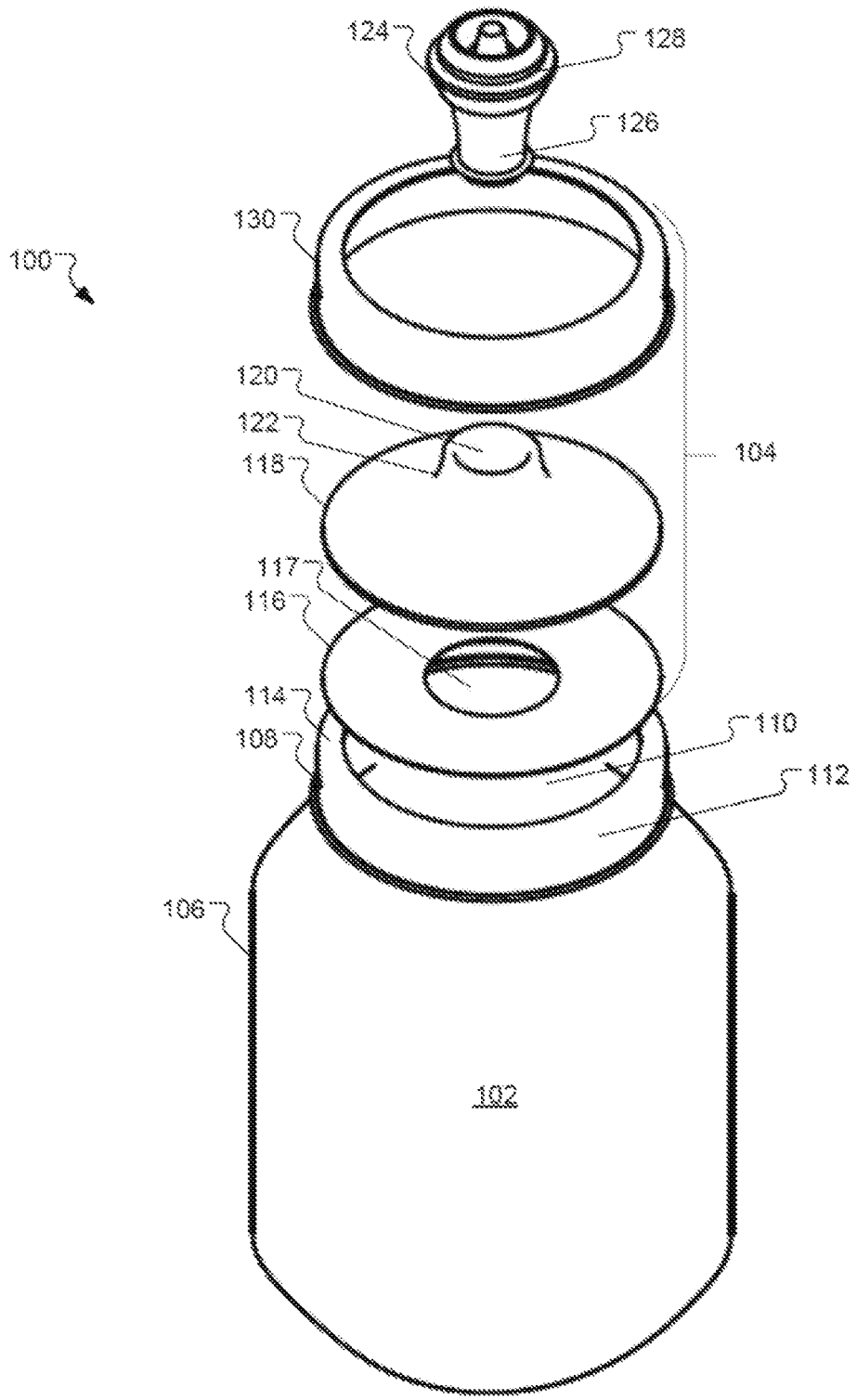
FIG. 1A shows a container system with a container and container adapter lid 104, according to an embodiment.

FIG. 1A shows a container system 100 with a container 102 and container adapter lid 104, according to an embodiment. The container 102 may include a body 106, a neck 108, and an opening 110. The body 106 of the container 102 may include a cavity to store an object. In one example, the object may be food, food ingredients, dried food, food storage items, and so forth. In another example, the object may be a liquid, such as wine, beer, soda, water, vinegar, olive oil, vegetable oil, and so forth. In another example, the object may be a toy, buttons, keys, lights, and so forth. The neck 108 may connect to a top portion of the body 106. For example, the body 106 may be a cylindrical body with a relatively flat base. The cylindrical body may extend from the base and a top portion of the body 106. The neck 108 may connect to the top portion of the body 106. In one example, the body 106 may taper inward toward the neck 108. In one embodiment, the neck 108 may include threads or grooves 112 for a lid or the container adapter lid 104 to connect to. In another embodiment, the neck 108 may include a hinge for the lid or the container adapter lid 104 to connect to. The opening 110 of the container 102 may provide an opening for an object to be placed into the cavity of the body 106 or removed from the cavity of the body 106. The neck 108 may include a rim 114 at a top portion of the neck that extends around the opening 110.

In one embodiment, the container 102 may be a mason jar. In another embodiment, the container may be an apothecary jar, a jelly jar, a cup, or a bowl. The container 102 may be glass, plastic, rubber, ceramic, polyurethane, and so forth. In one example, the container 102 may be cylinder shaped. In another example, the container 102 may be square shaped, rectangular shaped, or another polygon shape. In another example, the neck 108 and the rim 114 may be cylinder shaped. In another example, the neck 108 and rim 114 may be square shaped, rectangular shaped, or another polygon shape.

The container adapter lid 104 may include a gasket 116, an adapter lid 118, a container band 130, and an adapter 124. The gasket 116 may be shaped to attach to the rim 114 of the container 102. For example, the rim 114 and the gasket 116 may be circle shaped and a diameter of the gasket 116 may be equal to or greater to a diameter of the rim 114. The gasket 116 may be placed on a top surface of the rim 114 to form a seal between the rim 114 and the gasket 116. In one embodiment, the gasket 116 may include a hole 117. The hole 117 may be less than the diameter of the rim 114. In one example, the hole 117 may be located at approximately a center of the gasket 116 or at the center of the gasket 116. The hole 117 may provide an opening for objects to pass through to be placed in the cavity of the body 106 or be retrieved from the body 106.

The gasket 116 and/or the adapter lid 119 may be circular shaped, oval shaped, square shaped, rectangular shaped, or another polygon shape. The adapter lid 118 may be shaped to attach to the gasket 116. For example, the adapter lid 118 may be placed on top of the gasket 116. In one embodiment, the adapter lid 118 may be shaped to attach to the gasket 116. In another embodiment, the adapter lid 118 may also rest with the gasket 116 on the rim 114. For example, the adapter lid 118 and the gasket 116 may be circle shaped. In one embodiment, a diameter of the adapter lid 118 may be equal to or greater to a diameter of the gasket 116. In another embodiment, a diameter of the adapter lid 118 may be equal to or greater to a diameter of the rim 114.

In one example, a bottom surface of the gasket 116 may be placed on the top surface of the rim 114. In another example, a bottom surface of the adapter lid 118 may be placed on a top surface of the gasket 116 to form a seal between the adapter lid 118 and the gasket 116. The adapter lid 118 may include an opening 120. The opening 120 may be less than the diameter of the rim 114. The opening 120 may provide an opening or channel for objects to pass through for an individual to place in the cavity of the body 106 or retrieve from the body 106. In one embodiment, the opening 120 may be located at the center of the adapter lid 118 or approximate to the center of the adapter lid 118. In another embodiment, the opening may be located off center of the adapter lid 118.

The adapter lid 118 may include an opening wall 122 formed around at least a first portion of the opening 120. In one embodiment, the opening wall 122 may extend from a top surface of the adapter lid 118. In one example, the opening wall 122 may form a dome or cone-shaped wall around the opening 120. In another example, the opening wall 122 may form a cylinder around the opening 120. In another example, the opening wall 122 may be tapered at an angle at from an outer portion or edge of the top surface of the adapter lid 118 to the opening 120 of the adapter lid 118.

The opening 120 and the opening wall 122 may be shaped to receive an adapter 124. For example, a diameter of the opening 120 may be approximately the same as a diameter of at least a bottom portion of the adapter 124. In one example, the diameter may be within the range of approximately 13.5 millimeters (mm) to 21 mm. For example, the adapter 124 may include a bottom portion 126 and a top portion 128. In one embodiment, a diameter or size of the bottom portion 126 may be approximately the same diameter or size as the top portion 128. In another embodiment, a diameter or size of bottom portion 126 may be less than a diameter or size of the top portion 128. When the adapter is inserted into the opening 120, the bottom portion may be inserted into the opening 120. The opening wall 122 may encircle or circumscribe at least part of the sides of the adapter 124 to hold the adapter 124 in place within the opening 120. The adapter 124 may be a bottle stopper, a liquid pourer, a wine pourer, a wine aerator, a stopper, a vacuum seal attachment, a fermentation spout, a one-way valve, a metered pour spout, and so forth.

The container band 130 may be a ring or band that may attach to the neck 108 of the container 102. The container band 130 (also referred to as a screw band) may be a flat, thin strip or loop of material that may be shaped to fit around the gasket 116 and the adapter lid 118. For example, the container band 130 may include threads that may screw onto the threads 112 of the neck 108. A diameter of the container band 130 may be greater than a diameter of the gasket 116 and the adapter lid 118 to fit over the top of the gasket 116 and the adapter lid 118 and attach to the neck 108 of the container 102. For example, the container band 130 may fit over the top of the gasket 116 and the adapter lid 118 and screw onto the threads 112 of the neck 108 of the container 102.

As the container band 130 is screwed onto the threads 112, the container band 130 may compress the gasket 116 and the adapter lid 118 to form a seal between the rim 114, the gasket 116, the adapter lid 118, and/or the container band 130. For example, the container band 130 may include threads along an inner perimeter of the container band 130 and the container 102 may include threads along an outer perimeter of the neck 108. When the container band 130 is screwed onto the threads 112, the container band 130 may compress an outer perimeter of the gasket 116 and the adapter lid 118 to seal against the rim 114 of the container 102. In another embodiment, the gasket 116 and the adapter lid 118 may be compressed against the rim 114 by downward pressure from a vacuum seal. For example, the adapter 124 may be a vacuum seal adapter that removes the air from the container 102. As the air is removed from the container 102, the lack of air may create a vacuum that may seal, such as a hermetic seal, the gasket 116 and adapter lid 118 against the rim 114.

In one embodiment, the container band 130 may connect to the neck 108 of the container 102 by a friction fit, a compression fit, epoxy, a fastener, and so forth. In one example, the container band 130 may include threads to connect with the threads 112 of the container 102.

Figure 1B:
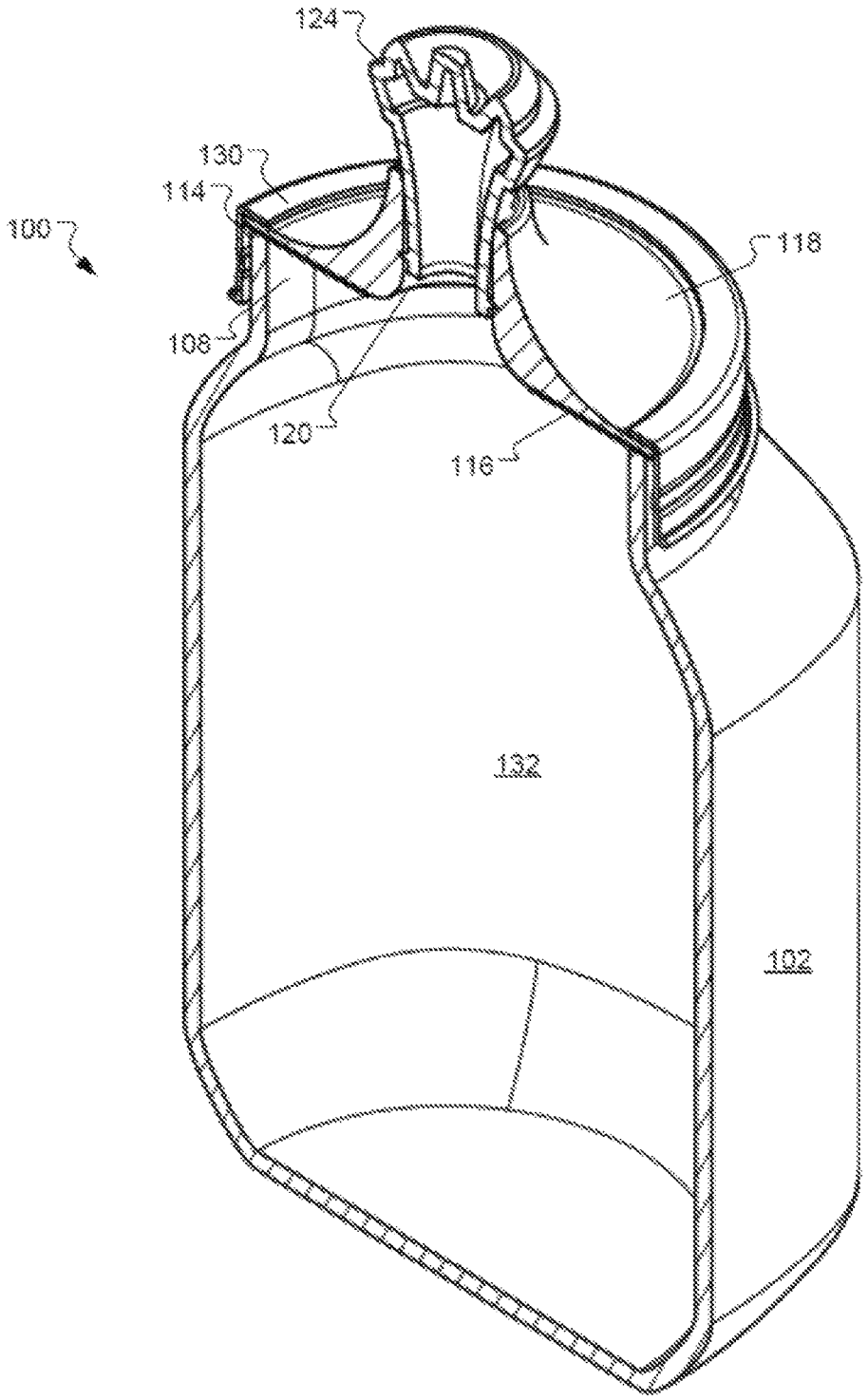
FIG. 1B shows a side view of a cross-section of the container system in FIG. 1A, according to an embodiment.

FIG. 1B shows a side view of a cross-section of the container system 100 in FIG. 1A, according to an embodiment. Some of the features in FIG. 1B are the same or similar to some of the features in FIG. 1A as noted by the same reference numbers, unless expressly described otherwise. FIG. 1B shows an assembled view of the container system 100. The container band 130 may be attached to the neck 108 of the container 102 to seal the gasket 116 and the adapter lid 118 to the rim 114 of the container 102. The adapter 124 may be inserted into at least part of the opening 120 of the adapter lid 118. When assembled, the container 102, the container adapter lid 104, and the adapter 124 may form an enclosed cavity 132 to store objects. When the adapter 124 is removed from the opening 120, the opening 120 may provide a channel to put objects into the cavity 132 or remove objects from the cavity 132. When the adapter 124 is placed back into the opening 120, the cavity may again be sealed and enclosed.

Figure 2A:
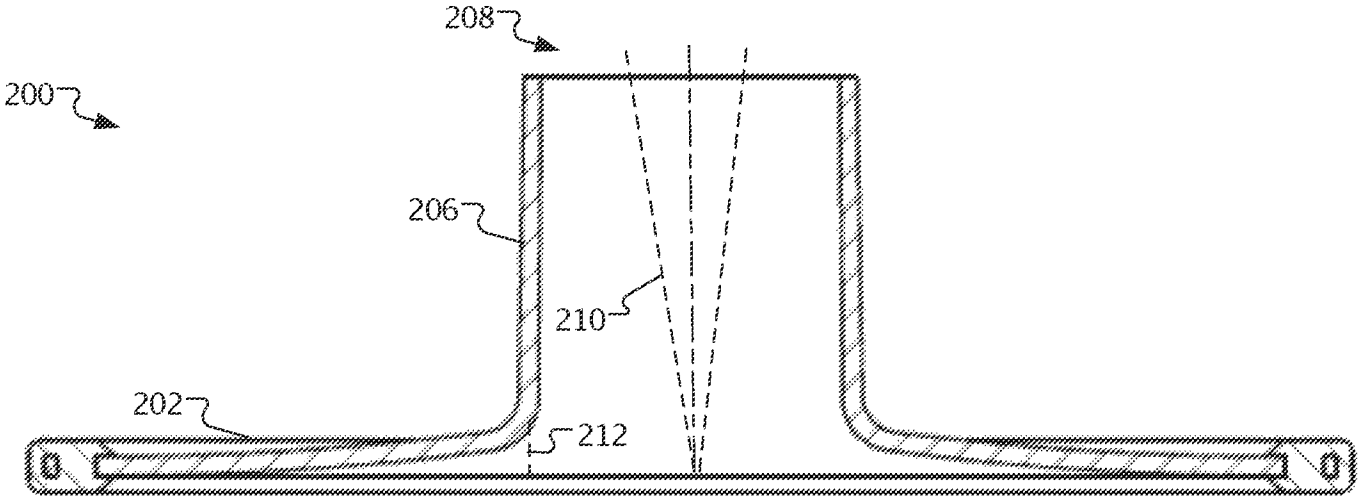
FIG. 2A shows a cross-sectional view of an adapter lid, according to an embodiment.

FIG. 2A shows a cross-sectional view of an adapter lid 200, according to an embodiment. The adapter lid 200 may include a planar wall 202 and an opening wall 206 extending upward from the planar wall 202. The opening wall 206 may extend around an opening 208 in the planar wall 202 to form a dome, a cone, or a spout. For example, the edges of the opening 208 may form a base for the opening wall 206 and the opening wall 206 may be a wall that tapers from planar wall to a point above the surface of the planar wall.

In one embodiment, the planar wall 202 may be flat and extend along a horizontal plane and the opening wall 206 may be perpendicular or at a 90-degree angle relative to the planar wall 202. In another embodiment, an angle 210 (also referred to as a bore angle) of the opening wall 206 may vary relative to the planar wall 202. In one example, the opening wall 206 may extend upward from the planar wall 202 at an angle 210 relative to the planar wall. In one embodiment, the angle 210 the opening wall 206 extends upward from the planar wall 202 may range between a 30-degree angle and a 90-degree angle relative to the planar wall (as discussed in FIG. 5C).

In one embodiment, the planar wall 202 may extend at a perpendicular angle without tapering from an outer edge of the planar wall to the opening 208. In another embodiment, the planar wall 202 may extend upwardly at an angle 212 from an outer edge of the planar wall to the opening 208. In one example, the angle 212 may range from 1 degree to 10 degrees relative to a horizontal plane. The angle 212 of the planar wall 202 may provide a natural slope to direct liquid slipped onto a top surface of the adapter lid 200 as the liquid is poured through the opening 208 to drain from the top surface of the planar wall 202. For example, when a portion of the liquid poured into the opening 208 is spilled onto a top of the planar wall, the angle 212 of 1 degree to 10 degrees may direct the spilt liquid to flow off a surface of the planar wall 202 and away from the opening 208. In another example, when the adapter lid 200 is reversed such that the spout of the opening wall 206 is facing down, the liquid may be directed from the top surface of the planar wall 202 to drain to the opening 208 of the adapter lid. In another embodiment, the angle 212 of the planar wall 202 may stiffen and reinforce the overall structure of the adapter lid 200 to increase a durability and robustness of the adapter lid 200.

In another embodiment, to form the planar wall 202 at the angle 212 and the opening wall 206 at the angle 210, the adapter lid may be a plastic material or a metal material that is stretched or stamped to form the planar wall 202 at the angle 212 and the opening wall 206 at the angle 210. In another embodiment, the adapter lid 200 may be formed using injection molding to form the planar wall 202 at the angle 212 and the opening wall 206 at the angle 210. In another embodiment, the planar wall 202 and the opening wall 206 may be individually formed and then connected together, such as by epoxy, soldering, or welding.

In another embodiment, the opening wall 206 may be a flexible or bendable material to flex as weight is placed on the opening wall 206. For example, if an individual were to accidentally steps on the opening wall 206 of the adapter lid 200, the opening wall 206 may flex or bend to avoid breaking and/or injuring the individual. In another example, the opening wall 206 may be a rigid material that does not flex to increase a durability and robustness of the opening wall 206 and the adapter lid 200. The material of the opening wall 206 may have a minimum threshold rigidity to maintain a structure that an individual may insert an adapter into.

Figure 2B:
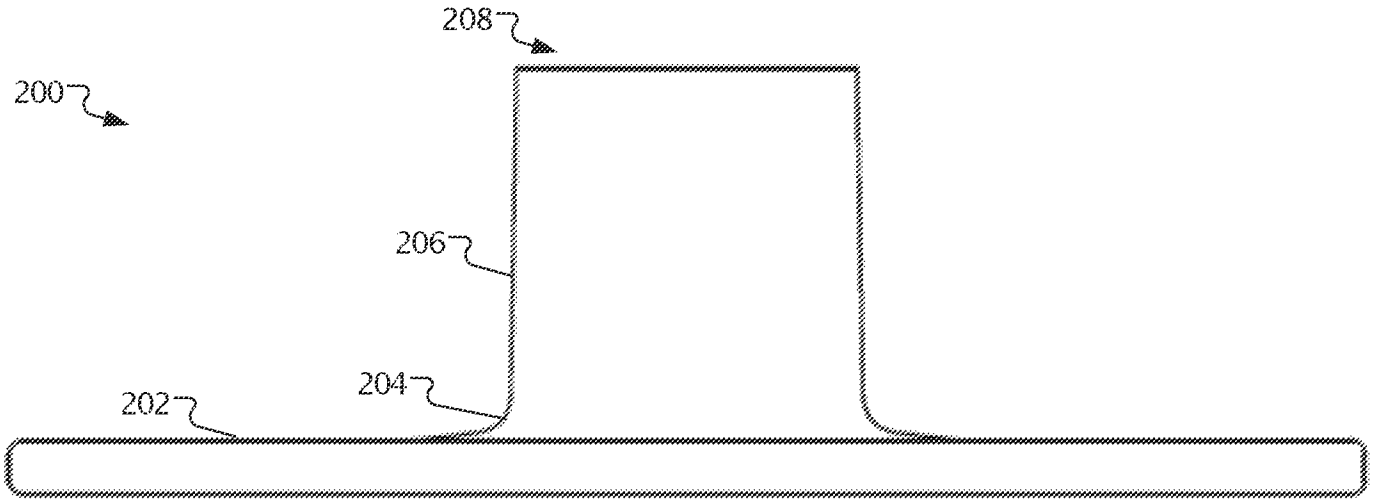
FIG. 2B illustrates a side view of the adapter lid, according to an embodiment.

FIG. 2B illustrates a side view of the adapter lid 200, according to an embodiment. Some of the features in FIG. 2B are the same or similar to some of the features in FIG. 2A as noted by the same reference numbers, unless expressly described otherwise. As discussed above, the planar wall 202 may be flat and extend along a horizontal plane and the opening wall 206 may extend upward perpendicular to the planar wall 202. In one embodiment, the adapter lid 200 may include a curved portion 204 that may connect the planar wall 202 to the opening wall 206. The curved portion 204 may be a curved or tapered portion of the adapter lid 200 that may form a bend or a curved corner to connect the planar wall 202 to the opening wall 206.

Figure 3A:
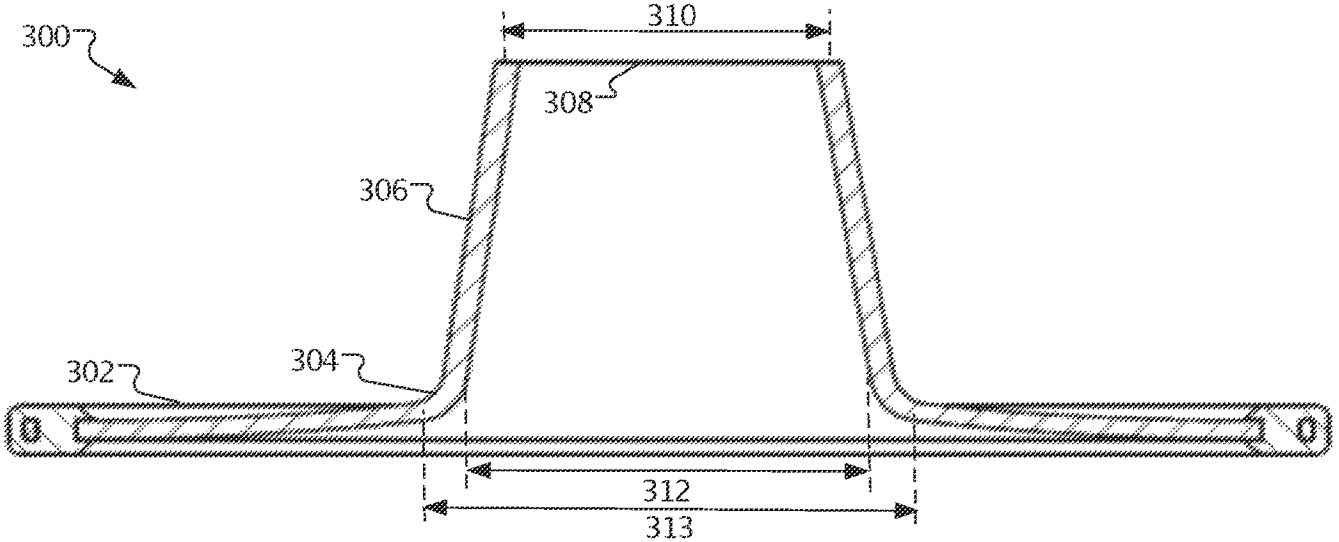
FIG. 3A shows a side cross-sectional view of the adapter lid, according to an embodiment.

FIG. 3A shows a side cross-sectional view of the adapter lid 300, according to an embodiment. The adapter lid 300 may include a planar wall 302 and an opening wall 306 extending upward from the planar wall 302. The opening wall 306 may extend around an opening 308 in the planar wall 302 to form a dome, a cone, or a spout. For example, the edges of the opening 308 may form a base for the opening wall 306 and the opening wall 306 may be a wall that tapers from planar wall 302 to a point above the surface of the planar wall 302.

In one embodiment, the opening wall 306 may taper inward at an angle, where a top opening 310 of the opening wall 306 is smaller than a bottom opening 312 of the opening wall 306. In one example, a diameter of the top opening 310 may be 18.9 millimeters (mm) and a diameter of the bottom opening 312 may be 19.1 mm. The diameter of the bottom opening 312 may be measured after the opening wall 306 connects to the by a curved portion 304. For example a diameter of the bottom opening 313 that includes the curved portion may be 24.8 mm. The diameters of the top opening 310 and the bottom opening 312 are not intended to be limiting and may vary. For example, while the ratio or relationship of the diameter of the top opening 310 being smaller than the diameter of the bottom opening 312 may remain constant, the diameters of the top opening 310 and/or the bottom opening 312 may range within 16 mm-20 mm. In another example, the diameter of the top opening 310 may be between 0.1 mm to 0.5 mm smaller than the diameter of the bottom opening 312 and the overall diameters of the top opening 310 and the bottom opening 312 may vary. In another embodiment, the diameters of the top opening 310 and/or the bottom opening 312 may vary based on the type of adapters the adapter lid 300 is configured to receive.

The inward tapering of the opening wall 306 may enable the adapters to be inserted into the top opening 310 when the adapter lid 300 is normal orientation and connected to a mason jar, as discussed above, and also be inserted into the bottom opening 312 when the adapter lid 300 is in a reverse orientation while maintaining an airtight seal for both the normal orientation and the reverse orientation. For example, an adapter may have an end configured to be inserted into the top opening 310 and the bottom opening 312, where a diameter of the end of the adapter is 19 mm.

When the adapter lid 300 is in the normal orientation and the adapter is inserted into the top opening 310, the top opening 310 may expand or flex to be 19 mm in diameter as the adapter is inserted into the top opening 310 while the diameter of the bottom opening 312 may remain 19.1 mm. When the diameter of the top opening 310 expands, the top opening 310 may form an airtight seal around the adapter as the elastic nature of the opening wall 306 may contract the top opening 310 around the adapter.

When the adapter lid 300 is in the reverse orientation and the adapter is inserted into the bottom opening 312, the bottom opening 312 may maintain a diameter that is larger than the diameter of the adapter. As the adapter is inserted into the bottom opening 312, the adapter may be inserted to extend to or past the top opening 310. As the adapter extends to or past the top opening 310, the top opening 310 may expand or flex to be 19 mm in diameter. When the diameter of the top opening 310 expands, the top opening 310 may form an airtight seal around the adapter as the clastic nature of the opening wall 306 may contract the top opening 310 around the adapter. In one embodiment, to insert the adapter into the top opening 310 and/or the bottom opening 312, the adapter may be inserted into the top opening 310 or the bottom opening 312 with a sufficient amount of pressure to minimally deform or compress the opening wall 306 to deform or expand the top opening 310. In another embodiment, the adapter may inflate or deflate to increase or decrease a diameter of the end of the adapter, respectively, and form the air-tight seal between at least one of the top opening 310 or the bottom opening 312.

The type of adapters that may be inserted into the top opening 310 and/or the bottom opening 312 may vary. For example, the adapters may include a cork, a stopper, a vacuum plug, a Champaign® stopper, a bottle stopper, a liquid pourer, a wine pourer, a wine aerator, a vacuum seal attachment, a fermentation spout, a one way valve, a metered pour spout, and so forth.

In one embodiment, the adapter lid 300 may include a curved portion 304 that may connect the planar wall 302 to the opening wall 306. The curved portion 304 may be a curved or tapered portion of the adapter lid 300 that may form a bend or a curved corner to connect the planar wall 302 to the opening wall 306. The curved portion 304 may be configured to compress or deform as the adapter is inserted into the top opening 310 or the bottom opening 312 to aid in the top opening 310 and/or the bottom opening 312 in forming the airtight seal.

Figure 3B:
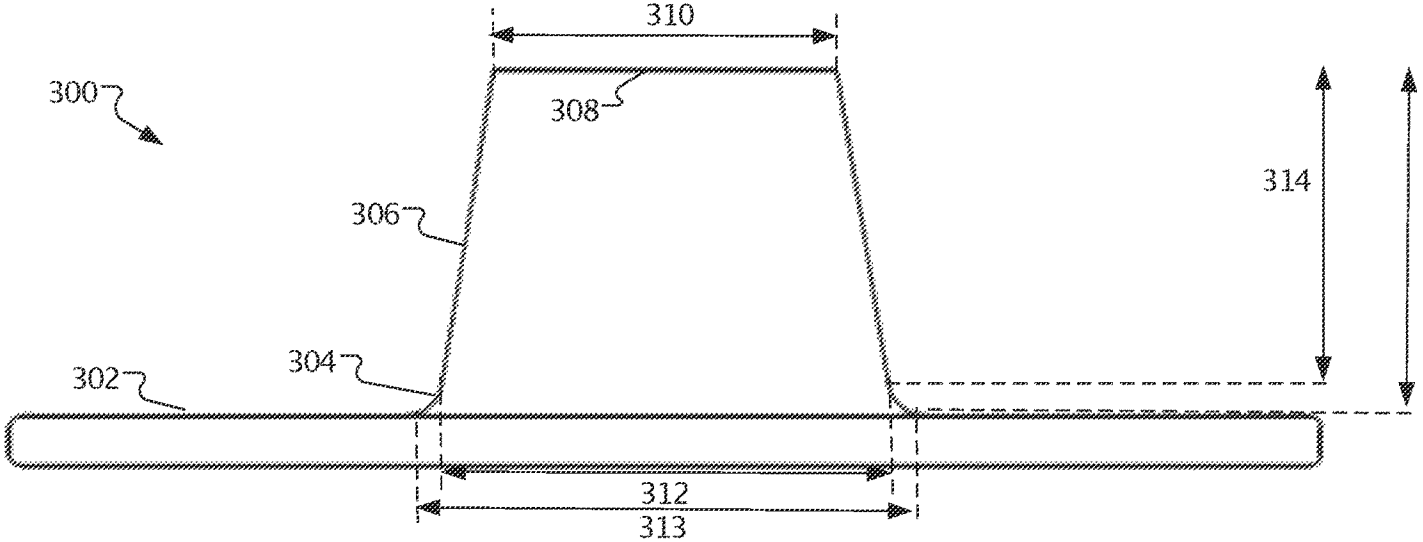
FIG. 3B shows a side view of the adapter lid, according to an embodiment.

FIG. 3B shows a side view of the adapter lid 300, according to an embodiment. Some of the features in FIG. 3B are the same or similar to some of the features in FIG. 3A as noted by the same reference numbers, unless expressly described otherwise. In one embodiment, an overall height of adapter lid 300 from a top surface of the planar wall 302 to the top opening 310 may be 23 mm and a height of the opening wall 306 from the curved portion 304 to the top opening 310 may be 20 mm. As discussed below, the dimensions of the adapter lid 300 or other adapter lids discussed herein may vary and are not intended to be limiting. For example, the overall height 316 of adapter lid 300 from a top surface of the planar wall 302 to the top opening 310 may be range from 18 mm to 25 mm and a height 314 of the opening wall 306 from the curved portion 304 to the top opening 310 may range from 17 mm to 24 mm.

FIG. 4A illustrates an adapter lid 400 without a gasket, according to an embodiment. The adapter lid 400 may be similar to the adapter lids 100, 118, 200, or 300. As discussed above, the adapter lid 400 may be attached to a container similar to the container 102 in FIG. 1 with a gasket 116 to form a seal between the adapter lid 400 and the container. In one embodiment, the adapter lid 400 may be attached directly to the container.

FIG. 4B illustrates an adapter lid 400 with a gasket, according to an embodiment. The adapter lid 400 may be similar to the adapter lids 100, 118, 200, or 300. As discussed above, the adapter lid 400 may be attached to a container similar to the container 102 in FIG. 1 with a gasket 116 to form a seal between the adapter lid 400 and the container. In one embodiment, the gasket 116 may be integrated into the adapter lid 400. In another embodiment, the gasket 116 may be attached around an outer rim or edge of the adapter lid 400. When the gasket 116 is integrated into or attached to the outer rim or edge of the adapter lid 400, the gasket 116 may encompass or enclose around the outer rim or edge to provide a gasket 116 around a top surface of the edge and a bottom surface of the edge.

In another embodiment, the gasket 116 may be separate from the adapter lid 400 and may be configured to attach to the adapter lid 400 when the adapter lid 400 are in a normal orientation or a reverse orientation. The separate gasket 116 may enable a user to replace or upgrade the gasket 116 apart from the adapter lid 400.

FIG. 4C illustrates an adapter lid 400 in a normal orientation with a gasket, according to an embodiment. The adapter lid 400 may be similar to the adapter lids 100, 118, 200, or 300. When the adapter lid 400 are attached to a container similar to the container 102 in FIGS. 1A and 1B, a container band similar to the container band 130 may be attached to the container to compress the gasket 116 and the adapter lid 400 to form a seal between the container and the adapter lid 400, according to one embodiment.

FIG. 4D illustrates an adapter lid 400 in a reverse orientation with a gasket, according to an embodiment. The adapter lid 400 may be similar to the adapter lids 100, 118, 200, or 300. When the adapter lids 400 are attached to a container similar to the container 102 in FIGS. 1A and 1B, a container band similar to the container band 130 may be attached to the container to compress the gasket 116 and the adapter lid 400 to form a seal between the container and the adapter lid 400, according to one embodiment. In another embodiment, the gasket 116 may be positioned above the adapter lid 400 when the adapter lid 400 are in the normal orientation in FIG. 4C and/or the reverse orientation in FIG. 4D.

As discussed above, the dimensions of the adapter lid 400 may vary. Also as discussed above, the location and/or angle of the opening wall of the adapter lid 400 may vary.

FIGS. 1A-3B illustrate the adapter lids 118, 200, and 300, respectively, having a first diameter for a container with an opening having the first diameter. For example, the adapter lids 118, 200, and 300, respectively, may have a first diameter to attach to a wide-mouth Mason jar. FIG. 5A illustrates an adapter lid 500 having a first diameter for a container with an opening having a second diameter, according to an embodiment. For example, the adapter lid 500 may have a second diameter to attach to a regular-mouth Mason jar. In one example, the first diameter of the opening of the wide mouth Mason jar may be 3 in (76 mm) inner diameter and 3⅜ in (86 mm) outer diameter and the second diameter of the opening of the regular mount Mason jar may be 2⅜ in (60 mm) inner diameter and 2¾ in (70 mm) outer diameter. The other features of the adapter lid 500 may be the same as the features of the adapter lids 118, 200, and/or 300.

FIGS. 1A-3B illustrate the adapter lids 118, 200, and 300, respectively, with the opening wall 122, 206, and 306, respectively, being located at a center or middle of the adapter lids 118-300.

FIG. 5B illustrates an adapter lid 510 having an offset or off-center opening wall 512, according to an embodiment. For example, the off-center opening wall 512 may be located approximate an edge of the adapter lid 510. The off-center opening wall 512 may be 10 mm from the center of the adapter lid 500, 18 mm from the center of the adapter lid 500, 25 mm from the center of the adapter lid 500, and so forth. The distance the off-center opening wall 512 is from the center of the adapter lid 500 is not intended to be limiting. The other features of the adapter lid 510 may be the same as the features of the adapter lids 118, 200, and/or 300.

FIGS. 1A-3B illustrate the adapter lids 118, 200, and 300, respectively, with the opening wall 122, 206, and 306, respectively, at a perpendicular or vertical orientation.

FIG. 5C illustrates an adapter lid 520 having an angled opening wall 522, according to an embodiment. For example, the angled opening wall 522 may be oriented at an angle relative to a top surface of the adapter lid 520. The angle of the angled opening wall 502 may be 30 degrees, 45 degrees, 60 degrees, and so forth. The angle of the angled opening wall 502 is not intended to be limiting. The other features of the adapter lid 520 may be the same as the features of the adapter lids 118, 200, and/or 300.

FIG. 6A illustrates a perspective view of an adapter lid 600, according to an embodiment. The adapter lid 600 may provide for closure of a container system, for example, such as the container system 800. The perspective view of FIG. 6A may illustrate one or more lobes 602 about an outer circumference of the lid 600.

FIG. 6B illustrates a top view of the adapter lid 600, according to an embodiment. The top view of FIG. 6B may illustrate further the protrusion characteristic of each of the lobes 602.

The lobes 602 may obviate a need for a user of the lid 600 to carefully place the lid along a center line. Thus, the lobes 602 may function to maintain the lid 600 in a centered position within a container band as well as provide for a tighter fit. The presence of the lobes 602 centering the lid may further increase an ability to form a hermetic seal between the lid 600 and a container, by ensuring a uniform disposition of the lid 600 on a surface of the container. The lobes may be flexible, for example, made of an elastomer, and be able to pass past inward protrusions or threads within a container band by elastically deforming (e.g., flexing) as the lid 800 is inserted into the container band. The use of the lobes 602 as compared to having a uniform outer radius of the lid 600 being greater than a radius of the protrusions or threads within the container band may provide for easier insertion into the container band, as there may be less material to interfere with the features, protrusions, or threads within the container band.

For example, in the depicted lid 600 there may be three lobes 602. In other embodiments, there may be, inter alia, one lobe 602, two lobes 602, four lobes 602, five lobes 602, six lobes 602, or more. Each of the lobes 602 may be shaped so as to provide for a fit of the lid 600 to a container band. For example, each of the lobes 602 may be shaped as arc-shaped, semi-circular shaped, semi-elliptical shaped, triangular-shaped, rectangular-shaped, or another polygonal- or irregular-shaped protrusion about an outer circumference of the lid 602. Each lobe 602 may be sized such that a bending force imposed proximate an outer surface of the lobe may cause the lobe to elastically deform and pass past the ridges and/or threads of a container band. Thus, the distance which each lobe 602 extends beyond the outer radius of the lid 600 may be such that the lid 600's radius extends to the inner radius of the container band. The lobe 602 or the lobes 602 may be positioned about a circumference of the lid 600. For example, the lobes 602 may be positioned substantially equidistant from each other about the circumference of the lid 600. A detail view 604 may illustrate further the geometry of a given lobe 602.

FIG. 6C illustrates the detail view 604 of the adapter lid 600, according to an embodiment. The detail view 604 may illustrate a difference in gasket geometry as compared to a lid having a substantially circular outer edge as compared to the lid 600 having a lobe 602.

The lobe 602 may provide for deforming a gasket, which may follow a path 608, as compared to following a path 606 if the gasket were to have been installed on a substantially circular lid. The deformation of the gasket along path 608 may provide for a gasket having lobes following the lobe 602, and thus may provide for loosely securing the lid 600 within a container band while being able to form an airtight, or watertight seal with a container when fully assembled thereto.

FIG. 7A illustrates a perspective view of a container system 700, according to an embodiment. The container system 700 may provide for the containment of objects and easy disassembly for cleaning. The container system 700 may include a container 702 which may have their two assembled a lid 704 using a container band 706. The container band 706 may, via screwing onto the container 702 to press or tighten the lid 704 against the container 702, forming a closed cavity for the storage of items.

FIG. 7B illustrates an exploded view the container system 700, according to an embodiment. The exploded view of the container system 700 may illustrate how, and in which order, the container 702, the lid 704, and the container band 706 are assembled. A lid, such as lid 704, may be centered to provide for an improved seal with a container, which may, in turn, improve a seal between the lid and a container by, inter alia, reducing air exchange between the interior and exterior of the container that could contaminate or spoil the contents of the container. The lid 704 may include one or more lobes, for example, similar to the lobe 602, which may provide for the effect of centering the lid 804 within the container band 706.

FIG. 8A illustrates an exploded view of a lid assembly 800, according to an embodiment The lid assembly 800 may depict the relationship between the lid 804 and the container band 802 prior to assembly.

The lobes may provide for an ability to secure the lid 804 within the container band 802, such that when the container band 802 is removed from a container (e.g., disassembled), the lid 804 may not fall apart from the container band 802. Thus, the container band 802 and the lid 804 assembled together may be manipulated, washed, dried, or stored without the lid 804 separating from the container band 802. The lobes may provide for selectively securing the lid 804 within the container band 802. Given a flexibility of the lid 804 the lid may be pressed into the container band 802, elastically deforming the lobes as they pass internal protrusions within the container band 802 and returning to their normal state once the lid 804 has been fully inserted into the container band 802. Thus, the lid 804 may, when not closing a container, may rotate freely and fit loosely within the container band so as to provide for, for example, easy cleaning.

FIG. 8B illustrates an exploded view of the lid assembly 800, according to an embodiment. The lid assembly 800 may depict the relationship between the lid 804 and the container band 802 prior to assembly.

FIG. 9A illustrates a cross section view of a container system 900, according to an embodiment. The cross section view of the container system 900 may provide detail as to the assembled disposition of a lid 904, a gasket 906, and a container 902 using a container band 908.

The gasket 906 may be, for example, disposed about an outer edge of the lid 904. The lid and gasket assembly may be disposed upon a top end of a container 902 via the container band 908. The lid and gasket assembly may be loosely secured within the container band 908 as described above. A detail view 910 may provide for greater detail as to the fit of the lid and the container band 908.

FIG. 9B illustrates the detail view 910 of the container system 900, according to an embodiment. The detail view 910 may provide for greater detail as to the fit of the lid and the container band 908.

The lid 904 and or the gasket 906 may have an increased outer dimension (e.g., a radius increased over a portion of the perimeter of the lid 904) provided for by a lobe of the lid 904. The container band 908 may have a protrusion 912, for example a protrusion which decreases a radius of the container band 908 for a small portion of the height of the container band 908. As illustrated by the dimension 914, the radius of the gasket 906 may be greater than the radius of the protrusion 912, thereby preventing the gasket 906 and the lid 904 from falling out of the container band 908.

FIG. 10A illustrates a bottom perspective view of an adapter lid assembly 1000, according to an embodiment. The adapter lid assembly 1000 may include a lid 1002 and a gasket 1004 disposed about an external circumference of the lid 1002. The adapter lid assembly 1000 may be similar to the adapter lid assembly 100, 200, or 300 as depicted in FIG. 4B.

FIG. 10B illustrates an exploded view of the adapter lid assembly 1000, according to an embodiment. The adapter lid assembly 1000 may include a lid 1002 and a gasket 1004, which may be sized to be disposed about an external circumference of the lid 1002. In the exploded view of FIG. 10B, it may be illustrated that the gasket 1004 may be separated from the lid 1002 and may have an inner radius smaller than an outer radius of the lid 1002. The adapter lid assembly 1000 may be similar to the adapter lid assembly 100, 200, or 300 as depicted in FIG. 4B.

FIG. 11A illustrates a top perspective view of an adapter lid assembly 1100, according to an embodiment. The adapter lid assembly 1100 may include a lid 1102 and a gasket 1104 disposed about an external circumference of the lid 1102. The adapter lid assembly 1100 may be similar to the adapter lid assembly 100, 200, or 300 as depicted in FIG. 4B, or the adapter lid assembly 1000, as depicted in FIG. 10A.

FIG. 11B illustrates a bottom perspective view of the adapter lid assembly 1100, according to an embodiment. The adapter lid assembly 1100 may include a lid 1102 and a gasket 1104 disposed about an external circumference of the lid 1102. The adapter lid assembly 1100 may be similar to the adapter lid assembly 100, 200, or 300 as depicted in FIG. 4B, or the adapter lid assembly 1000, as depicted in FIG. 10A.

FIG. 11C illustrates an exploded view of the adapter lid assembly 1100, according to an embodiment. The adapter lid assembly 1100 may include a lid 1102 and a gasket 1104, which may be sized to be disposed about an external circumference of the lid 1102. In the exploded view of FIG. 11C, it may be illustrated that the gasket 1104 may be separated from the lid 1102 and may have an inner radius smaller than an outer radius of the lid 1102. The adapter lid assembly 1000 may be similar to the adapter lid assembly 100, 200, or 300 as depicted in FIG. 4B.

The disclosure above encompasses multiple distinct embodiments with independent utility. While each of these embodiments has been disclosed in a particular form, the specific embodiments disclosed and illustrated above are not to be considered in a limiting sense as numerous variations are possible. The subject matter of the embodiments includes all novel and non-obvious combinations and sub-combinations of the various elements, features, functions and/or properties disclosed above and inherent to those skilled in the art pertaining to such embodiments. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and sub-combinations of the disclosed embodiments that are believed to be novel and non-obvious. Embodiments embodied in other combinations and sub-combinations of features, functions, elements and/or properties may be claimed through amendment of those claims or presentation of new claims in the present application or in a related application. Such amended or new claims, whether they are directed to the same embodiment or a different embodiment and whether they are different, broader, narrower or equal in scope to the original claims, are to be considered within the subject matter of the embodiments described herein.

The invention claimed is:

1. A container system, comprising:

a container comprising a body with a cavity to hold an object and a first opening to receive the object, wherein the container is a mason jar;

a gasket configured to attach to a rim of the first opening of the container to form a first seal between the rim and an adapter lid;

the adapter lid comprising:

a planar wall extending along a horizontal plane, the planar wall being configured to attach to the gasket and extend along the rim of the first opening, wherein the planar wall comprises a second opening to provide a passage for the object to enter the cavity of the container;

three lobes disposed about the planar wall and substantially coplanar with the planar wall, wherein:

each lobe is configured to extend an outer dimension of the planar wall over a portion of a perimeter of the planar wall;

each lobe is semi-elliptical shaped;

each lobe is positioned substantially equidistant from the other two lobes;

an opening wall configured to circumscribe the second opening and extend perpendicularly from the horizontal plane to form a spout, wherein the adapter lid is configured to:

attach to the rim of the container in a normal orientation such that:

the opening wall extends upwardly and away from the cavity; and the adapter lid is operable to receive an adapter at a top of the opening wall; and attach to the rim of the container in a reverse orientation such that:

the opening wall extends downwardly and into the cavity; and the adapter lid is operable to receive the adapter at a bottom of the opening wall; and a container band shaped to attach the gasket and the adapter lid to the rim of the container, wherein the three lobes are configured to:

deform elastically, thereby permitting insertion of the adapter lid into the container band; and return to an undeformed position to centrally locate the adapter lid within the container band.

2. The container system of claim 1, wherein the opening wall tapers inward from a bottom of the opening wall to a top of the opening wall such that a first diameter of the opening wall at the bottom of the opening wall is greater than a second diameter of the opening wall at the top of the opening wall.

3. The container system of claim 2, wherein the adapter lid is configured to receive an adapter at the top of the opening wall or the bottom of the opening wall.

4. The container system of claim 3, wherein the adapter is operable to form an airtight seal with the top of the opening wall as the adapter is inserted into the top of the opening wall or the bottom of the opening wall.

5. The container system of claim 1, wherein the adapter lid comprises:

four lobes;

five lobes;

six lobes; or eight lobes.

6. The container system of claim 1, wherein an outer circumference of the planar wall slopes upward at an angle to an inner circumference of the planar wall circumscribing the second opening.

7. The container system of claim 6, wherein:

when the adapter lid is in the normal orientation, the slope of the planar wall is configured to direct liquid on a top surface of the planar wall away from the opening wall; or when the adapter lid is in the reverse orientation, the slope of the planar wall is configured to direct liquid on the top surface of the planar wall toward the opening wall.

8. The container system of claim 1, wherein:

the gasket is integrated onto an outer circumference of the planar wall;

the gasket is operable to be positioned below a bottom surface of the planar wall when the adapter lid is in the normal orientation; or the gasket is operable to be positioned on or above a top surface of the planar wall when the adapter lid is in the reverse orientation.

9. The container system of claim 1, wherein the second opening is offset from a center of the planar wall such that the opening wall is offset from the center of the planar wall.

10. An adapter lid, comprising:

a planar wall extending along a horizontal plane, the planar wall being configured to attach to a gasket and extend along a rim of a container, wherein the planar wall comprises an opening to provide a passage for an object to enter a cavity of the container;

a lobe disposed about the planar wall and substantially coplanar with the planar wall, the lobe configured to:

extend an outer dimension of the planar wall over a portion of a perimeter of the planar wall;

deform elastically, thereby permitting insertion of the adapter lid into a container band; and return to an undeformed position to centrally locate the adapter lid within the container band;

an opening wall configured to circumscribe the opening and extend from the horizontal plane to form a spout, wherein the adapter lid is configured to:

attach to the rim of the container in a normal orientation such that:

the opening wall extends upwardly and away from the cavity; and the adapter lid is operable to receive an adapter at a top of the opening wall; and attach to the rim of the container in a reverse orientation such that:

the opening wall extends downwardly and into the cavity; and the adapter lid is operable to receive that adapter at a bottom of the opening wall.

11. The adapter lid of claim 10, wherein the container is a mason jar.

12. The adapter lid of claim 10, wherein the adapter is at least one of a bottle stopper, a liquid pourer, a wine pourer, a wine aerator, a stopper, a fermentation spout, a one-way valve, a metered pour adapter, or a vacuum seal attachment.

13. The adapter lid of claim 10, wherein:

the opening wall tapers inward from the bottom of the opening wall to the top of the opening wall such that a first diameter of the opening wall at the bottom of the opening wall is greater than a second diameter of the opening wall at the top of the opening wall; and the adapter lid is configured to receive the adapter at the top of the opening wall or the bottom of the opening wall wherein the adapter is operable to form an airtight seal with the top of the opening wall as the adapter is inserted into the top of the opening wall or the bottom of the opening wall.

* * * * *